US005399183A

United States Patent [19]

Adam

[11] Patent Number: 5,399,183

[45] Date of Patent: Mar. 21, 1995

[54] PROCESS FOR TRICHROMATIC DYEING OR PRINTING

[75] Inventor: Jean-Marie Adam, Rosenau, France

[73] Assignee: Ciba-Geigy Corporation, Ardsley, N.Y.

[21] Appl. No.: 157,852

[22] Filed: Nov. 24, 1993

[30] Foreign Application Priority Data

Dec. 3, 1992 [CH] Switzerland ..... 3719/92

[51] Int. Cl.[6] ..... C09B 00/00; D06P 3/06; D06P 3/14

[52] U.S. Cl. ..... 8/641; 8/643; 8/662; 8/676; 8/682; 8/681; 8/687; 8/917; 8/924

[58] Field of Search ..... 8/641, 643, 662, 676, 8/681–687, 917, 924

[56] References Cited

U.S. PATENT DOCUMENTS

| | | | |
|---|---|---|---|
| 4,402,704 | 9/1983 | Raisin et al. | 8/641 |
| 4,445,905 | 5/1984 | Schaetzer et al. | 8/641 |
| 4,447,358 | 5/1984 | Schwander et al. | 260/205 |
| 4,537,598 | 8/1985 | Schaetzer et al. | 8/641 |
| 4,579,561 | 4/1986 | Rowe et al. | 8/641 |
| 4,652,269 | 3/1987 | Bowles et al. | 8/641 |
| 4,840,643 | 6/1989 | Rowe | 8/641 |
| 5,092,905 | 3/1992 | Doré | 8/638 |
| 5,094,665 | 3/1992 | Maüsezahl | 8/641 |
| 5,131,919 | 7/1992 | Maüsezahl | 8/643 |

FOREIGN PATENT DOCUMENTS

| | | |
|---|---|---|
| 052578 | 5/1982 | European Pat. Off. . |
| 127579 | 12/1984 | European Pat. Off. . |
| 425434 | 5/1991 | European Pat. Off. . |
| 2197940 | 3/1974 | France . |
| 1438354 | 6/1976 | United Kingdom . |

*Primary Examiner*—Paul Lieberman
*Assistant Examiner*—Margaret Einsmann
*Attorney, Agent, or Firm*—George R. Dohmann

[57] ABSTRACT

Process for the trichromatic dyeing or printing of natural or synthetic polyamide fibre materials, which comprises using at least one blue-dyeing anthraquinone dye of the formula

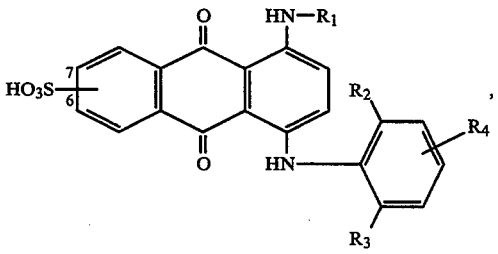

(1)

in which $R_1$, $R_2$, $R_3$ and $R_4$, independently of one another, are hydrogen or $C_1$–$C_6$alkyl, the sum of the carbon atoms of the radicals $R_1$, $R_2$, $R_3$ and $R_4$ being 4, 5 or 6 and the sulfo group in the anthraquinone dye of the formula (1) being attached in the position designated as 6 or 7, together with at least one red-dyeing dye of the formula (2) and at least one of the yellow- or orange-dyeing dyes of the formulae (3), (4) and (5), the dyes of the formulae (2), (3), (4) and (5) being as defined in claim 1.

The process according to the invention is suitable for dyeing natural or synthetic polyamide materials from an aqueous liquor or for printing with printing pastes.

13 Claims, No Drawings

PROCESS FOR TRICHROMATIC DYEING OR PRINTING

The present invention relates to a process for the trichromatic dyeing or printing of natural and synthetic polyamide fibre materials with at least one blue-dyeing, sulfo-containing anthraquinone dye, at least one red-dyeing azo dye and at least one yellow- or orange-dyeing azo dye.

The object of the present invention was to find a process for dyeing or printing natural and synthetic polyamide fibre materials with dyes suitable for being combined by the trichromatic principle.

It has now been found that this object can be achieved according to the invention by the process described below. The dyeings thus obtained fulfil the stated objects. Specifically, the dyeings obtained are distinguished by uniform colour build-up in combination with constancy of shade at various concentrations and good combinability compatibility.

The present invention provides a process for the trichromatic dyeing or printing of natural or synthetic polyamide fibre materials, which comprises using at least one blue-dyeing anthraquinone dye of the formula

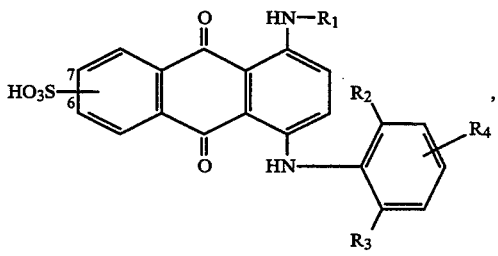

(1)

in which $R_1$, $R_2$, $R_3$ and $R_4$, independently of one another, are hydrogen or $C_1$–$C_6$alkyl, the sum of the carbon atoms of the radicals $R_1$, $R_2$, $R_3$ and $R_4$ being 4, 5 or 6 and the sulfo group in the anthraquinone dye of the formula (1) being attached in the position designated as 6 or 7, together with at least one red-dyeing dye of the formula

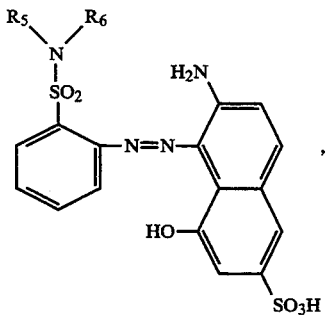

(2)

in which $R_5$ is phenyl or cyclohexyl and $R_6$ is $C_1$–$C_4$alkyl, or the radicals $R_5$ and $R_6$ together with the nitrogen atom linking them form an azepinyl ring, and at least one of the yellow- or orange-dyeing dyes of the formulae (3), (4) and (5)

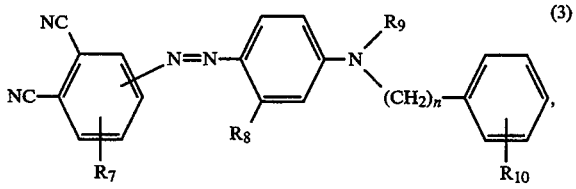

(3)

in which $R_7$, $R_8$and $R_{10}$, independently of one another, are hydrogen, $C_1$–$C_4$alkyl, $C_1$–$C_4$alkoxy, $C_2$–$C_4$alkanoylamino, halogen or sulfo, $R_9$ is hydrogen or $C_1$–$C_4$alkyl, and n is 1, 2, 3 or 4,

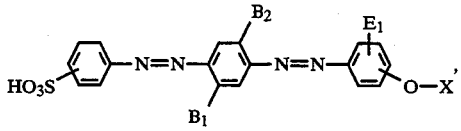

(4)

in which $B_1$, $B_2$ and $E_1$ are hydrogen, $C_1$–$C_4$alkyl or $C_1$–$C_4$alkoxy and X is straight-chain or branched $C_1$–$C_4$alkyl or straight-chain or branched $C_2$–$C_4$hydroxyalkyl,

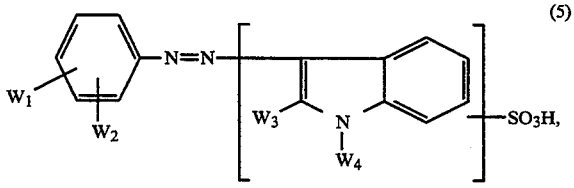

(5)

in which $W_1$ is phenylsulfonyl which may be substituted in the phenyl ting by $C_1$–$C_4$alkyl, $C_1$–$C_4$alkoxy or halogen, $W_2$ is hydrogen, halogen, $C_1$–$C_4$alkyl or $C_1$–$C_4$alkoxy, $W_3$ is $C_1$–$C_4$alkyl or unsubstituted or $C_1$–$C_4$alkyl-, $C_1$–$C_4$alkoxy- or halogen-substituted phenyl, and $W_4$ is hydrogen or $C_1$–$C_8$alkyl.

Trichromatic mixing is to be understood as meaning additive colour mixing of suitably chosen yellow- or orange-, red- and blue-dyeing dyes by means of which any desired hue of the visible colour spectrum can be obtained by suitable selection of the relative amounts of the dyes.

Examples of $R_1$, $R_2$, $R_3$ and $R_4$ in formula (1) as $C_1$–$C_6$alkyl are methyl, ethyl, propyl, isopropyl, butyl, isobutyl, sec-butyl, tert-butyl and straight-chain or branched pentyl or hexyl. Of these, the $C_1$–$C_4$alkyl radicals are preferred.

As a rule, the anthraquinone dyes of the formula (1) are used as mixtures of isomers, the individual isomers only differing with respect to the sulfo group attached in the 6- or 7-position; however, the individual isomers can also be used as individual dyes.

Examples of $R_6$, $R_7$, $R_8$, $R_9$, $R_{10}$, $B_1$, $B_2$, $E_1$, X, $W_2$ and $W_3$ as $C_1$–$C_4$alkyl are methyl, ethyl, propyl, isopropyl, butyl, isobutyl, sec-butyl or tert-butyl.

Examples of $R_7$, $R_8$, $R_{10}$, $B_1$, $B_2$, $E_1$ and $W_2$ as $C_1$–$C_4$alkoxy are methoxy, ethoxy, propoxy, isopropoxy, butoxy, sec-butoxy, isobutoxy or tert-butoxy.

Examples of $R_7$, $R_8$ and $R_{10}$ as $C_2$–$C_4$alkanoylamino are acetylamino, propionylamino or butyrylamino, in particular acetylamino.

Examples of $R_7$, $R_8$, $R_{10}$ and $W_2$ as halogen are fluorine or bromine and, in particular, chlorine.

A suitable $C_2$–$C_4$hydroxyalkyl radical for X is a straight-chain or branched hydroxyalkyl radical, for example a β-hydroxyethyl, β-hydroxypropyl, β-hydroxybutyl or α-ethyl-β-hydroxyethyl radical.

Examples of $W_4$ as a $C_1$–$C_8$alkyl radical are methyl, ethyl, propyl, isopropyl, butyl, isobutyl, sec-butyl, tert-butyl, and straight-chain or branched pentyl, hexyl, heptyl or octyl.

$W_1$ as phenylsulfonyl and $W_3$ as phenyl may be substituted in the phenyl ring by $C_1$–$C_4$alkyl, such as methyl, ethyl, propyl, isopropyl, butyl, isobutyl, sec-butyl or tert-butyl, $C_1$–$C_4$alkoxy, such as methoxy, ethoxy, propoxy, isopropoxy, butoxy, sec-butoxy, isobutoxy or tert-butoxy, or by halogen, for example fluorine, bromine or, in particular, chlorine.

The anthraquinone dyes of the formula (1) used are preferably those, in which $R_2$ and $R_3$, independently of one another, are methyl or ethyl and $R_4$ is hydrogen or methyl.

The radical $R_1$ in the anthraquinone dye of the formula (1) is preferably isopropyl or sec-butyl, in particular isopropyl.

Anthraquinone dyes of the formula (1), in which $R_1$ is isopropyl, $R_2$ and $R_3$, independently of one another, are methyl or ethyl, and $R_4$ is hydrogen or methyl are particularly preferred for the process according to the invention.

The sum of the carbon atoms of the radicals $R_1$, $R_2$, $R_3$ and $R_4$ in the anthraquinone dye of the formula (1) is preferably 5.

Very particular preference is given to anthraquinone dyes of the formula (1) in which $R_1$ is isopropyl, $R_2$ and $R_3$ are methyl, and $R_4$ is hydrogen.

The red-dyeing dye of the formula (2) used is preferably a dye of the formula (6)

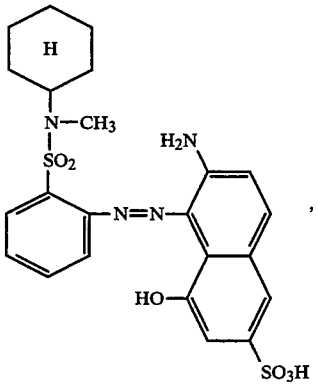

(7)

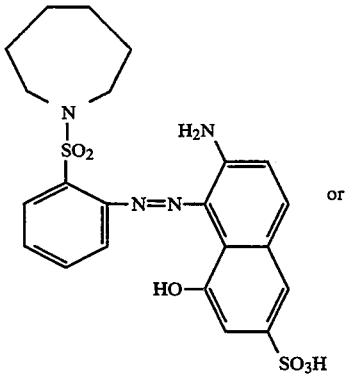

or

-continued (8)

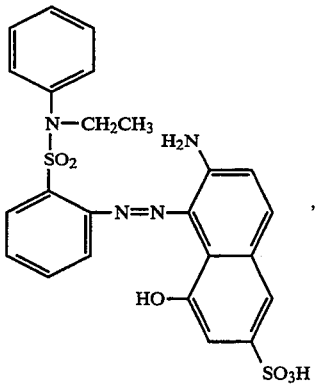

in particular a dye of the formula (6) or (7) and, preferably, a dye of the formula (6).

The yellow- or orange-dyeing dyes of the formula (3) are preferably sulfo-containing dyes.

The yellow- or orange-dyeing dyes of the formula (3) used are preferably those in which $R_7$ is hydrogen, $R_8$ and $R_9$ are $C_1$–$C_4$alkyl, $R_{10}$ is sulfo, and n is 1, in particular the dye of the formula (9)

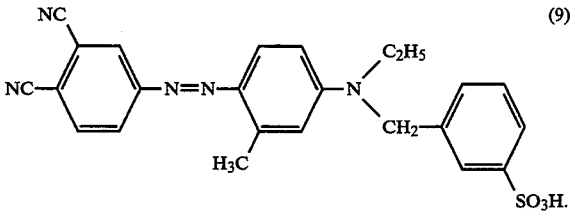

The yellow- or orange-dyeing dyes of the formula (4) used are preferably those in which $B_1$ and $B_2$, independently of one another, are $C_1$–$C_4$alkyl or $C_1$–$C_4$alkoxy, $E_1$ is hydrogen, and X is $C_1$–$C_4$alkyl, in particular the dye of the formula (10)

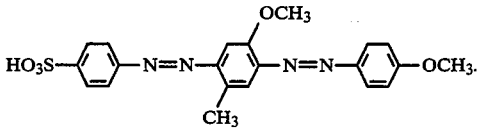

The yellow- or orange-dyeing dyes of the formula (5) used are preferably those in which $W_1$ is phenylsulfonyl, $W_2$ is hydrogen, halogen or $C_1$–$C_4$alkyl, $W_3$ is unsubstituted or $C_1$–$C_4$alkyl, $C_1$–$C_4$alkoxy- or halogen-substituted phenyl, and $W_4$ is hydrogen, in particular the dye of the formula (11)

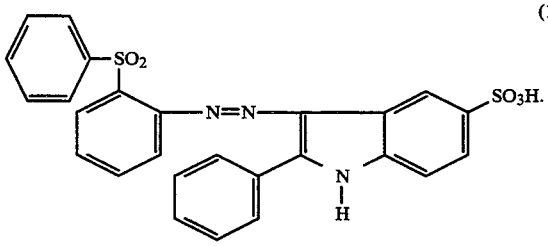

The yellow- or orange-dyeing dye used is particularly preferably a dye of the formula (3) in which $R_7$ is hydrogen, $R_8$ and $R_9$ are $C_1$–$C_4$alkyl, $R_{10}$ is sulfo, and n is 1, or a dye of the formula (4), in which $B_1$ and $B_2$, independently of one another, are $C_1$–$C_4$alkyl or $C_1$–$C_4$alkoxy, $E_1$ is hydrogen, and X is $C_1$–$C_4$alkyl, or a dye of the formula (5), in which $W_1$ is phenylsulfonyl, $W_2$ is hydrogen, halogen or $C_1$–$C_4$alkyl, $W_3$ is unsubstituted or $C_1$–$C_4$alkyl-, $C_1$–$C_4$alkoxy- or halogen-substituted phenyl, and $W_4$ is hydrogen.

The yellow- or orange-dyeing dye used is very particularly preferably a dye of the formula (9), (10) or (11).

Yellow- or orange-dyeing dyes which are of particular interest are the dyes of the formulae (3) and (5), for which the meanings and preferences are those given above, in particular the dyes of the formulae (9) and (11).

In a very particularly preferred embodiment of the process according to the invention, an anthraquinone dye of the formula (1) is used together with a red-dyeing dye of the formula (6) or (7) and a yellow- or orange-dyeing dye of the formula (9) or (11), the meanings and preferences for the anthraquinone dye of the formula (1) being those given above.

The present invention also provides mixtures of dyes which comprise at least one anthraquinone dye of the formula (1), at least one red-dyeing dye of the formula (2) and at least one yellow- or orange-dyeing dye of the formulae (3), (4) and (5). The meanings and preferences for the dyes of the formulae (1), (2), (3), (4) and (5) are those given above.

The dyes of the formulae (1), (2), (3), (4) and (5) used in the process according to the invention for trichromatic dyeing or printing are known or can be prepared analogously to known dyes. Thus, for example, the anthraquinone dyes can be obtained by the direction given in GB-A-1 438 354.

The dyes used in the process according to the invention for trichromatic dyeing or printing are present either in the form of their free sulfonic acid or, preferably, as their salts.

Examples of suitable salts are the alkali metal salts, alkaline earth metal salts or ammonium salts or the salts of an organic amine. Examples are the sodium salts, lithium salts, potassium salts or ammonium salts or the salt of mono-, di- or triethanolamine.

The dyes used in the process according to the invention can contain further additives, for example sodium chloride or dextrin.

The process according to the invention for trichromatic dyeing or printing can be applied to the customary dyeing and printing methods. The dyeing liquors or printing pastes can contain, apart from water and the dyes, further additives, for example wetting agents, antifoams, levelling agents, or agents influencing the property of the textile material, for example softeners, additives for flameproof finish or soil-, water- and oil-repellent agents and water softeners and natural or synthetic thickeners, for example alginates and cellulose ethers.

The process according to the invention for trichromatic dyeing or printing is also suitable for dyeing from short liquors, for example in continuous dyeing methods or batchwise and continuous foam dyeing methods.

The dyes used in the process according to the invention are distinguished, when used for trichromatic dyeing or printing, by uniform colour build-up, good affinity, good constancy of shade even at different concentrations, good fastness properties and, in particular, by very good compatibility.

The process according to the invention for trichromatic dyeing or printing is suitable for dyeing or printing not only natural polyamide materials, for example wool but also in particular synthetic polyamide materials, for example nylon 6 or nylon 6.6, and is suitable for dyeing or printing blend fabrics or yarns of wool and synthetic polyamide.

The textile material mentioned can be present in a wide range of processing forms, for example as fibre, yam, woven fabric or knitted fabric and, in particular, in the form of carpets.

Level dyeings exhibiting good general fastness properties, in particular good rub, wet, wet rub and light fastness properties, are obtained.

In the examples which follow, parts are by weight. Temperatures are degrees centrigrade.

Parts by weight relate to parts by volume as the gram relates to the cubic centimeter.

EXAMPLE 1

10 parts of a nylon-6.6 fibre material (Helanca tricot) are dyed in 200 pans of an aqueous liquor which contains 2 g/l of sodium acetate and is brought to a pH of 5 with acetic acid. The dyes used are 0.15% of the blue-dyeing dye which, in the form of the free acid, has the formula

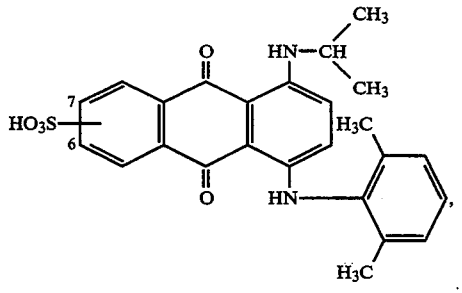

(101)

0.42% of the red-dyeing dye, which, in the form Df the free acid, has the formula

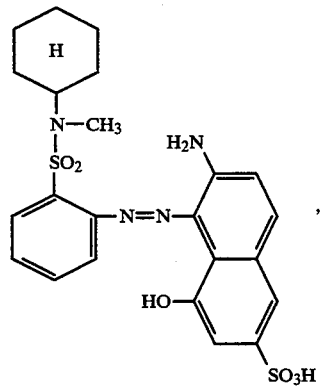

(102)

and 0.62% of the yellow-dyeing dye which, in the form of the free acid has the formula (103)

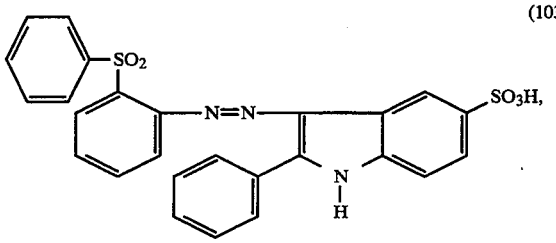

the amounts given being based on the fibre weight.

The dyeing time at a temperature of 98° C. is 30 to 90 minutes. The dyed polyamide fibre material is then removed and rinsed and dried as usual to give a completely level brown piece of fabric which does not exhibit any material-related barriness.

EXAMPLES 2 TO 4

Example 1 is repeated, except that an equimolar amount of the dye which, given in the form of the free acid, has the formula (104)

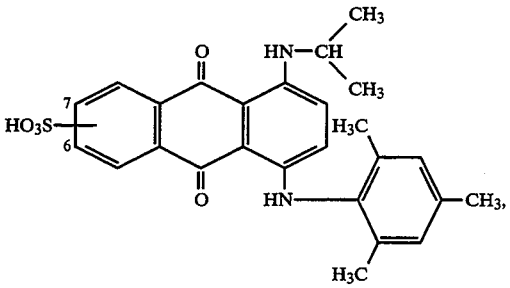

(105)

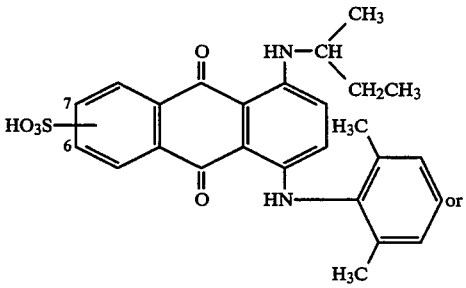

(106)

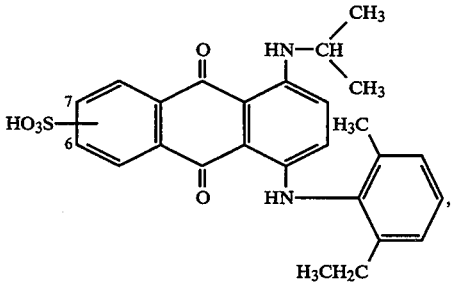

is used instead of 0.15% of the dye of the formula (101) to give likewise level brown pieces of fabric.

EXAMPLE 5:

Example 1 is repeated, except that 0.18% of the dye of the formula (101) is used instead of 0.15% of the dye of the formula (101), and 0.17% of the dye which, in the form of the free acid, has the formula (107)

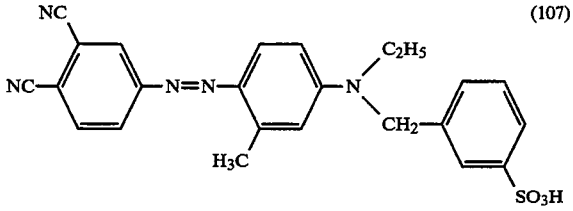

is used instead of 0.62% of the dye of the formula (103), to give likewise a level brown piece of fabric. Each of the anthraquinone dyes of the formulae (101), (104), (105) and (106) listed in the above examples is used as the mixture of isomers, the individual isomers only differing with respect to the sulfo group attached in the 6- or 7-position; the mixing ratio of the two isomers is about 1:1. However, it is also possible to use the individual isomers as individual dyes instead of the mixtures of isomers.

What is claimed is:

1. A process for the trichromatic dyeing or printing of natural or synthetic polyamide fibre materials, which comprises using at least one blue-dyeing anthraquinone dye of the formula (1)

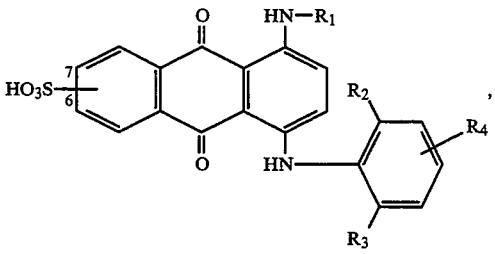

in which $R_1$, $R_2$, $R_3$ and $R_4$, independently of one another, are hydrogen or $C_1$–$C_6$alkyl, the sum of the carbon atoms of the radicals $R_1$, $R_2$, $R_3$ and R4 being 4, 5 or 6 and the sulfo group in the anthraquinone dye of the formula (1) being attached in the position designated as 6 or 7, together with at least one red-dyeing dye of the formula (2)

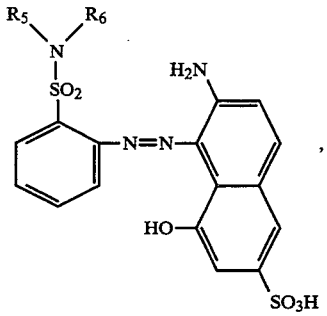

in which $R_5$ is phenyl or cyclohexyl and $R_6$ is $C_1$–$C_4$alkyl, or the radicals $R_5$ and $R_6$ together with the nitrogen atom linking them form an azepinyl ring, and at least one of the yellow- or orange-dyeing dyes of the formulae (3), (4) and (5)

(3)

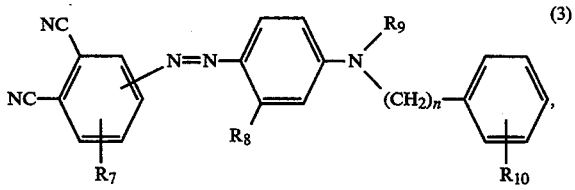

in which $R_7$ and $R_8$ independently of one another, are hydrogen, $C_1$–$C_4$alkyl, $C_1$–$C_4$alkoxy, $R_{10}$ is sulfo, $C_2$–$C_4$alkanoylamino, halogen or sulfo, $R_9$ is hydrogen or $C_1$–$C_4$alkyl, and n is 1, 2, 3 or 4, (4)

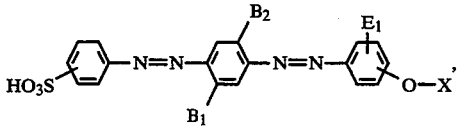

in which $B_1$, $B_2$ and $E_1$ are hydrogen, $C_1$–$C_4$alkyl or $C_1$–$C_4$alkoxy and X is straight-chain or branched $C_1$–$C_4$alkyl or straight-chain or branched $C_2$–$C_4$hydroxyalkyl, (5)

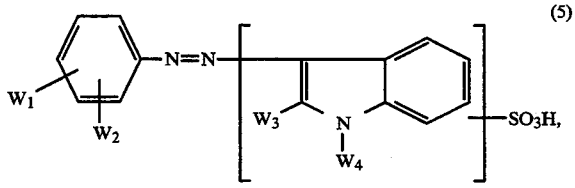

in which $W_1$ is phenylsulfonyl which is unsubstituted or substituted in the phenyl ring by $C_1$–$C_4$alkyl, $C_1$–$C_4$alkoxy or halogen, $W_2$ is hydrogen, halogen, $C_1$–$C_4$alkyl or $C_1$–$C_4$alkoxy, $W_3$ is $C_1$–$C_4$alkyl or unsubstituted or $C_1$–$C_4$alkyl-, $C_1$–$C_4$alkoxy- or halogen-substituted phenyl, and $W_4$ is hydrogen or $C_1$–$C_8$alkyl.

2. A process according to claim 1, wherein an anthraquinone dye of the formula (1) is used in which $R_2$ and $R_3$, independently of one another, are methyl or ethyl and $R_4$ is hydrogen or methyl.

3. A process according to claim 1, wherein an anthraquinone dye of the formula (1) is used in which $R_1$ is isopropyl or sec-butyl.

4. A process according to claim 1, wherein an anthraquinone dye of the formula (1) is used in which $R_1$ is isopropyl, $R_2$ and $R_3$, independently of one another, are methyl or ethyl, and $R_4$ is hydrogen or methyl.

5. A process according to claim 1, wherein an anthraquinone dye of the formula (1) is used in which the sum of the carbon atoms of the radicals $R_1$, $R_2$, $R_3$ and $R_4$ is 5.

6. A process according to claim 1, wherein a red-dyeing dye of the formula (6)

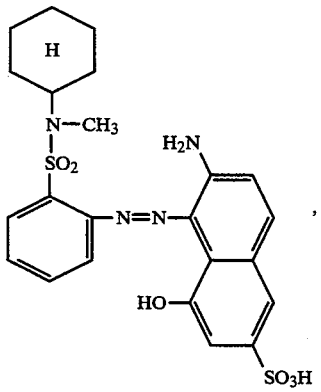

(7)

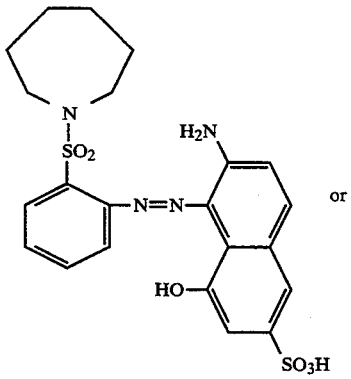

or (8)

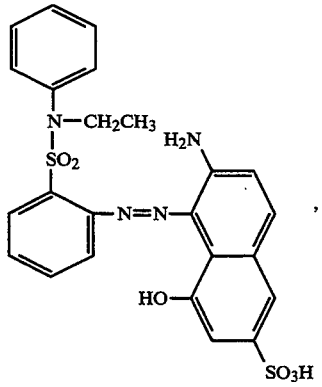

is used.

7. A process according to claim 6, wherein the red-dyeing dye used is a dye of the formula (6) or (7).

8. A process according to claim 1, wherein the yellow- or orange-dyeing dye used is a dye of the formula (3) in which $R_7$ is hydrogen, $R_8$ and $R_9$ are $C_1$–$C_4$alkyl $R_{10}$ is sulfo, and n, is 1, or a dye of the formula (4), in which $B_1$ and $B_2$, independently of one another, are $C_1$–$C_4$alkyl or $C_1$–$C_4$alkoxy, $E_1$ is hydrogen, and X is $C_1$–$C_4$alkyl, or a dye of the formula (5), in which $W_1$ is phenylsulfonyl, $W_2$ is hydrogen, halogen or $C_1$–$C_4$alkyl, $W_3$ is unsubstituted or $C_1$–$C_4$alkyl-, $C_1$–$C_4$alkoxy- or halogen-substituted phenyl, and $W_4$ is hydrogen.

9. A process according to claim 1, wherein the yellow- or orange-dyeing dye used is a dye of the formula

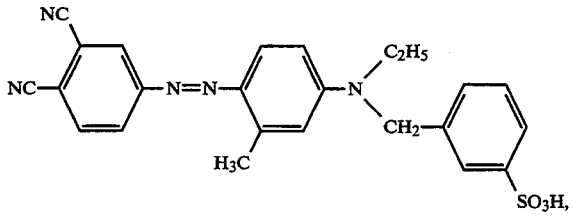

(9)

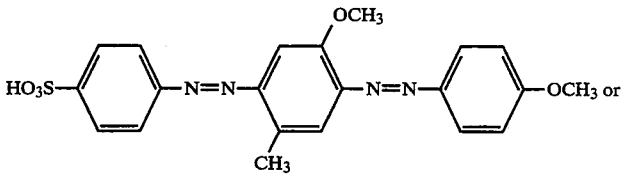

(10)

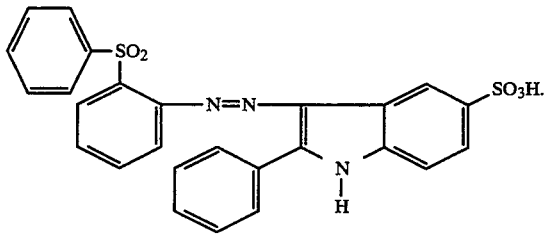

(11)

10. A process according to claim 6, wherein the red-dyeing dye used is a dye of the formula (6) or (7) and the yellow- or orange-dyeing dye used is a dye of the formula

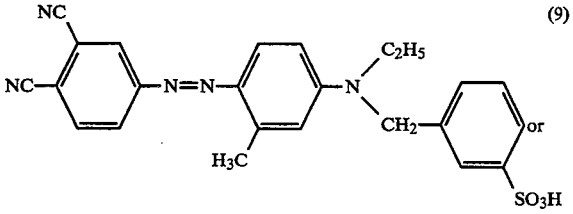

(9)

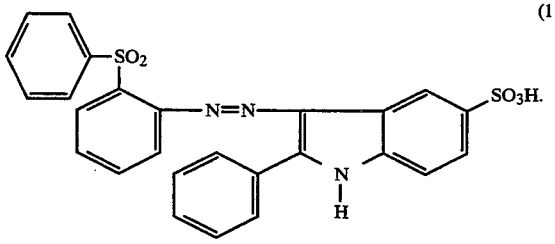

(11)

11. A process according to claim 1, wherein said fibre material is wool or synthetic polyamide fibre material.

12. A process according to claim 11, wherein said fibre material is synthetic polyamide fibre material.

13. A dye mixture, which comprises at least one blue-dyeing anthraquinone dye of the formula

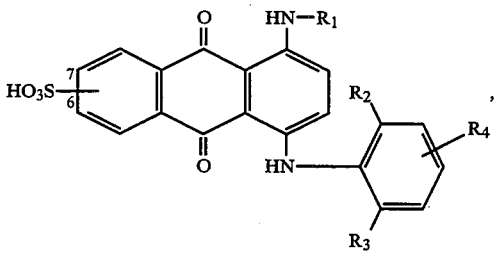

(1)

in which $R_1$, $R_2$, $R_3$ and $R_4$, independently of one another, are hydrogen or $C_1$–$C_6$alkyl, the sum of the carbon atoms of the radicals $R_1$, $R_2$, $R_3$ and $R_4$ being 4, 5 or 6 and the sulfo group in the anthraquinone dye of the formula (1) being attached in the position designated as 6 or 7, together with at least one red-dyeing dye of the formula

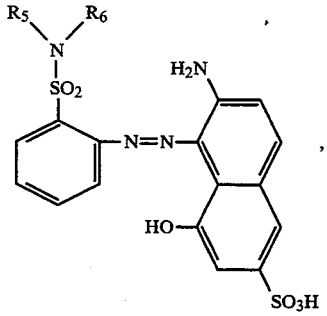

(2)

in which $R_5$ is phenyl or cyclohexyl and $R_6$ is $C_1$–$C_4$alkyl, or the radicals $R_5$ and $R_6$ together with the nitrogen atom linking them form an azepinyl ring, and at least one of the yellow- or orange-dyeing dyes of the formulae (3), (4) and (5)

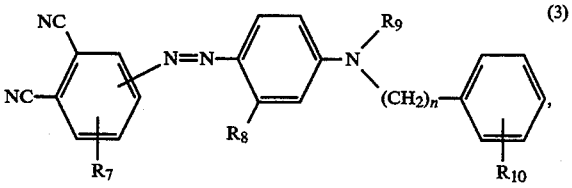

(3)

in which $R_7$ and $R_8$ independently of one another, are hydrogen, $C_1$–$C_4$alkyl, $C_1$–$C_4$alkoxy, $C_2$–$C_4$alkanoylamino, halogen or sulfo, $R_9$ is hydrogen or $C_1$–$C_4$alkyl, $R_{10}$ is sulfo, and n is 1, 2, 3 or 4,

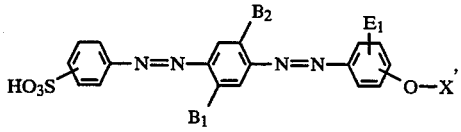

(4)

in which $B_1$, $B_2$ and $E_1$ are hydrogen, $C_1$–$C_4$alkyl or $C_1$–$C_4$alkoxy and X is straight-chain or branched $C_1$–$C_4$alkyl or straight-chain or branched $C_2$–$C_4$hydroxyalkyl,

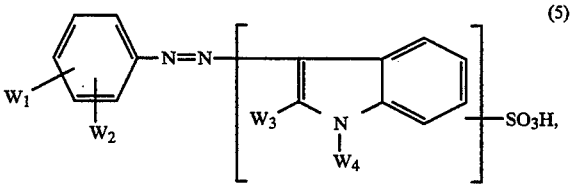

(5)

in which $W_1$ is phenylsulfonyl which is unsubstituted or substituted in the phenyl ring by $C_1$–$C_4$alkyl, $C_1$–$C_4$alkoxy or halogen, $W_2$ is hydrogen, halogen, $C_1$–$C_4$alkyl or $C_1$–$C_4$alkoxy, $W_3$ is $C_1$–$C_4$alkyl or unsubstituted or $C_1$–$C_4$alkyl-, $C_1$–$C_4$alkoxy- or halogen-substituted phenyl, and $W_4$ is hydrogen or $C_1$–$C_8$alkyl.

* * * * *